US010993485B2

(12) United States Patent
Kühl

(10) Patent No.: US 10,993,485 B2
(45) Date of Patent: May 4, 2021

(54) ITEM OF CLOTHING HAVING A DEVICE FOR PROTECTION AGAINST PESTS, IN PARTICULAR TICKS

(75) Inventor: Kai-Uwe Kühl, Dortmund (DE)

(73) Assignee: BLUCHER GMBH

( * ) Notice: Subject to any disclaimer, the term of this patent is extended or adjusted under 35 U.S.C. 154(b) by 1214 days.

(21) Appl. No.: 14/006,465

(22) PCT Filed: Feb. 3, 2012

(86) PCT No.: PCT/EP2012/000482
§ 371 (c)(1),
(2), (4) Date: Sep. 20, 2013

(87) PCT Pub. No.: WO2012/126551
PCT Pub. Date: Sep. 27, 2012

(65) Prior Publication Data

US 2014/0007319 A1 Jan. 9, 2014

(30) Foreign Application Priority Data

Mar. 21, 2011 (DE) ..... 10 2011 014 635.0

(51) Int. Cl.
*A41D 1/06* (2006.01)
*A41D 13/00* (2006.01)
(Continued)

(52) U.S. Cl.
CPC ..... *A41D 13/001* (2013.01); *A41D 1/06* (2013.01); *A41D 17/005* (2013.01); *A41F 17/04* (2013.01);
(Continued)

(58) Field of Classification Search
CPC ..... A41D 13/0543; A41D 13/001; A41D 13/065; A41D 17/00; A41D 17/005;
(Continued)

(56) References Cited

U.S. PATENT DOCUMENTS 653,157 A * 7/1900 Turner ..... A41D 1/06 2/227
1,652,750 A * 12/1927 Wohlgemuth ..... A41D 13/0002 2/210

(Continued)

FOREIGN PATENT DOCUMENTS

DE 7017573 U 8/1970
DE 29711103 U1 9/1997

(Continued)

OTHER PUBLICATIONS

English machine translation of FR 2076842 A5 (to Hauser) via espacenet.com.*

(Continued)

*Primary Examiner* — Jameson D Collier
(74) *Attorney, Agent, or Firm* — Edward E. Sowers; Brannon Sowers & Cracraft PC

(57) ABSTRACT

The invention provides an item of clothing in the form of trousers (1) for use outdoors and/or in hunting, having two trouser legs (2, 3) and a device for protecting against pests. To provide effective protection against pests, the device an internal insert (4), preventing the passage of pests, in particular ticks, is provided in at least one trouser leg (2,3), the lower end (5) of which insert reaches as far as the foot area (6) of the user and the upper end (8) of which insert reaches as far as the foot area (6) of the user and the upper end (8) of which is permanently connected or can be detachably connected to the trouser leg (2,3) on the inside, wherein the connection at the upper end (8) is closed circumferentially to prevent passage of the pest through connection (9).

22 Claims, 4 Drawing Sheets

(51) Int. Cl.
*A41D 17/00* (2006.01)
*A41F 17/04* (2006.01)
*A41D 31/30* (2019.01)

(52) U.S. Cl.
CPC ..... *A41D 31/305* (2019.02); *A41D 2300/20* (2013.01); *A41D 2600/108* (2013.01)

(58) Field of Classification Search
CPC .... A41D 17/02; A41D 17/04; A41D 13/0575; A41D 3/06; A41D 1/06; A41D 1/08; A41D 2400/34; A41D 2600/108; A41D 2300/20; Y10S 2/911; Y10S 2/919; A63B 71/1225; A63B 2071/125; A63B 2071/1258
USPC ..... 2/2.5, 4, 22–24, 51, 227, 242
See application file for complete search history.

(56) References Cited

U.S. PATENT DOCUMENTS 1,804,930 A * 5/1931 Head ..... A41D 13/02 2/162
2,203,401 A * 6/1940 Barnard ..... A41B 11/14 2/407
2,216,852 A * 10/1940 McMeekin ..... A41D 1/06 2/227
3,115,641 A * 12/1963 Rea ..... A41D 1/08 2/227
3,644,601 A * 2/1972 Miller et al. ..... A01N 57/02 558/103
3,671,975 A * 6/1972 Vorsteher ..... A41D 1/082 2/232
4,306,315 A * 12/1981 Castiglia ..... A63B 71/1225 2/22
4,386,438 A * 6/1983 Evin ..... A41D 1/06 2/272
4,625,336 A * 12/1986 Derderian ..... A41D 13/0015 2/227
4,773,100 A * 9/1988 Kuo ..... A41D 3/06 2/159
5,381,557 A * 1/1995 Luria ..... A01M 1/14 2/16
5,539,927 A * 7/1996 Holubec ..... A41D 1/08 2/227
5,794,268 A 8/1998 Pessey
6,134,717 A * 10/2000 Grilliot ..... A41D 13/0005 2/227
6,141,802 A * 11/2000 Drake ..... A41D 1/08 2/22
6,353,939 B1 3/2002 Arber
8,464,367 B1 * 6/2013 Mordecai ..... A43B 3/02 2/22
2003/0005505 A1 * 1/2003 DeMott ..... A41D 13/0581 2/23
2005/0086721 A1 * 4/2005 Lambertz ..... A41D 13/002 2/69
2006/0096008 A1 * 5/2006 Lin ..... A41D 3/06 2/242
2007/0000013 A1 * 1/2007 Lai ..... A41D 3/06 2/86
2008/0096001 A1 * 4/2008 Emden ..... A41D 31/02 428/222
2010/0212071 A1 * 8/2010 Bohringer ..... B01D 39/163 2/400
2016/0095358 A1 * 4/2016 Vercollone ..... A41D 1/082 2/269

FOREIGN PATENT DOCUMENTS

DE 202006011163 U1 7/2007
DE 102006020464 A1 * 10/2007 ..... A41D 1/06
DE 102007026340 A1 11/2008
DE 102009020866 A1 4/2011
FR 2076842 A5 * 10/1971 ..... A41D 1/082
JP 09228112 A 9/1997

OTHER PUBLICATIONS

NPL-USGS. "Raindrops are Different Sizes". USGS.gov. URL= "https://www.usgs.gov/special-topic/water-science-school/science/raindrops-are-different-sizes?qt-science_center_objects=0#qt-science_center_objects". Accessed Sep. 18, 2019. (Year: 2001).*

* cited by examiner

ITEM OF CLOTHING HAVING A DEVICE FOR PROTECTION AGAINST PESTS, IN PARTICULAR TICKS

CROSS-REFERENCES TO RELATED APPLICATIONS

This application is a National Stage filing of International Application PCT/EP2012/000482, filed Feb. 3, 2012, claiming priority to German Applications No. DE 10 2011 014 635.0 filed Mar. 21, 2011, entitled "Item of Clothing having a Device for Protection against Pests, in Particular Ticks." The subject application claims priority to PCT/EP2012/000482, and to German Applications No. DE 10 2011 014 635.0 and incorporates all by reference herein, in their entirety.

BACKGROUND OF THE INVENTION

The present invention relates to an item of clothing in the form of pants for use outdoors and/or in hunting, having two pant legs and a device for protection against pests, in particular ticks.

An item of clothing of the aforementioned type is already known from DE 10 2006 020 464 A1. This prior art relates to an item of protective clothing manufactured from a textile material and intended for arrangement on a body part. The item of protective clothing here is equipped with a tick trap pocket provided on a surface of the item of clothing. The tick trap pocket extends along at least a part of the circumference of a garment part which cloaks the body. The tick trap pocket has a walling which delimits the interior space of the pocket and a downward-facing opening which leads into the interior space of the pocket. A poison holder, which holds a contact poison for killing ticks and which is detachable via a hook and loop fastener, is located in said opening. It is disadvantageous in the known solution that chemical substances having a toxic effect are provided for the protection against ticks, said substances indeed killing off ticks but also possibly being detrimental to the health of the wearer.

BRIEF SUMMARY OF THE INVENTION

It is now an object of the present invention to provide an item of clothing of the type mentioned at the outset which offers effective protection against pests, in particular ticks, but without there having to be concerns about effects which could be detrimental to the health of the wearer.

The aforementioned object is substantially achieved according to the invention in the case of an item of clothing of the type mentioned at the outset in that an inner insert, which prevents the passage of pests, in particular ticks, is provided in at least one pant leg as device for protection against pests, the lower end of said insert reaching as far as into the foot region of the user, and the upper end of said insert being fixedly connected or detachably connectable to the pant leg on the inside, the connection at the upper end being closed in an encircling manner such that the pests cannot pass through the connection.

DETAILED DESCRIPTION OF THE INVENTION

Figure 1:
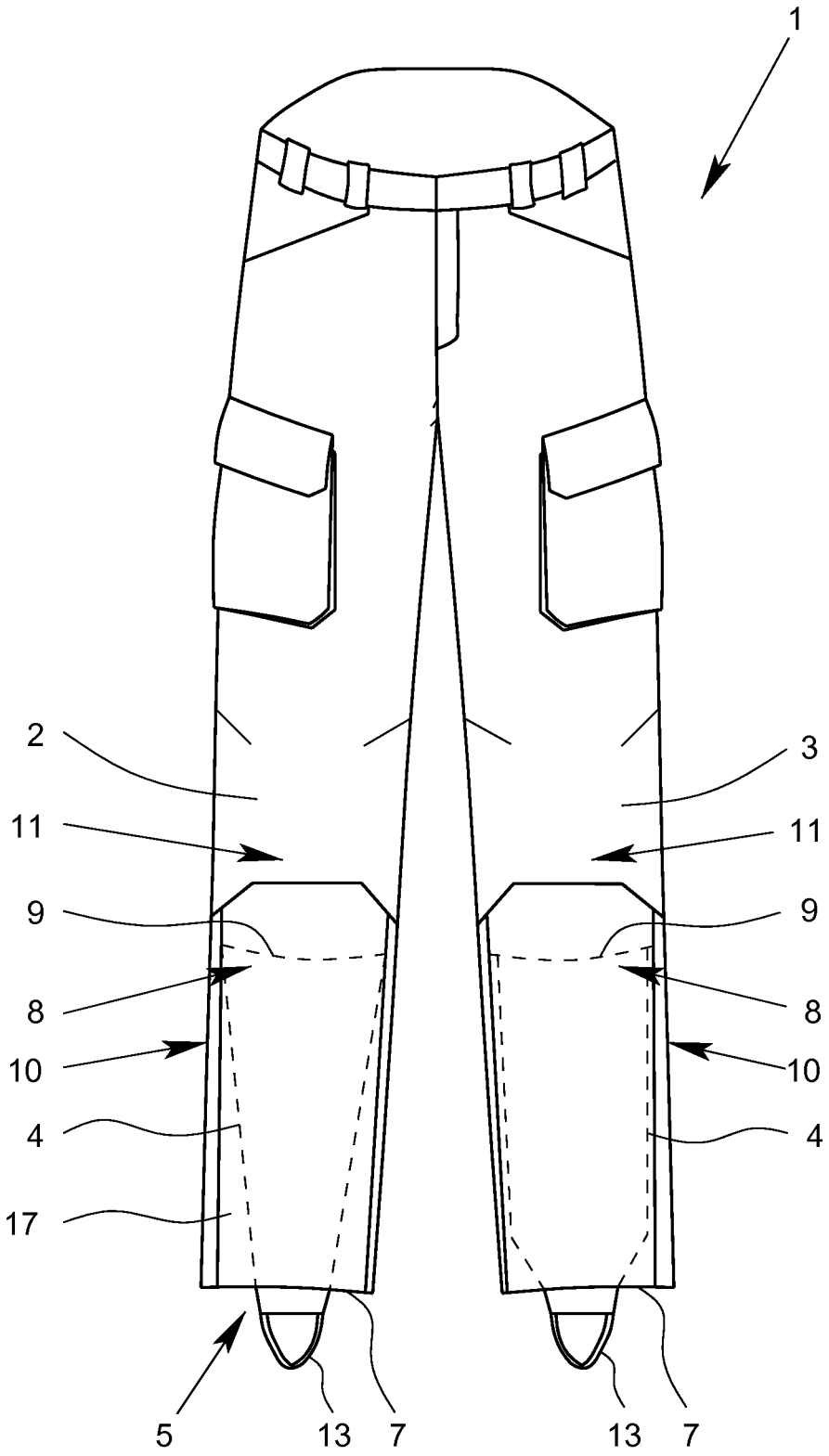
FIG. 1 shows a schematic illustration of an item of clothing according to the invention, parts of the pant legs in the lower region having been omitted for the sake of improved clarity of the invention.

On account of the aforementioned configuration—and in contrast to the prior art—a device for protection against pests is provided which operates purely mechanically and which makes it impossible for pests, in particular ticks, to reach the skin of the user via the opening of the pant leg. If a user wearing the pants according to the invention crosses a meadow, for example, and ticks make their way into the lower opening of the pant leg, the inner insert, on account of its configuration and connection to the pant leg, ensures that, while the ticks do indeed crawl up the inside of the pants, namely on the inside of the pant leg or on the outer side of the inner insert, they do not however reach any bare region of skin, since the inner insert is connected at its upper end to the pant leg in an encircling manner. Subsequently, the ticks are trapped at the end of the inner insert in the annular gap between the pant leg and the inner insert. It is in any case impossible for the ticks to bypass the inner insert and to reach the leg of the user.

In a preferred embodiment of the invention, the upper end of the inner insert is fastened in the pant leg in the calf region of the user, in particular in the upper calf region, and particularly preferably immediately above the calf region and below the knee region of the user. The inner insert thus has about the length of what is known as a knee-length sock. The advantage of this embodiment is that the user can readily wear high shoes or boots, the pant leg being worn on the outside over the shoe or the boot. The inner insert is then worn inside the shoe or inside the boot. This is important especially for the outdoor and hunting sector, since high, solid shoes and boots are worn there.

In order to have as far as possible no bare areas of skin even when using everyday shoes or slippers, it is particularly useful for the lower end of the inner insert to reach at least as far as the ankle region of the user. The inner insert thus reaches as far as possible into the foot region. In principle, the inner insert may reach up to the toes or even enclose the toes. In any case, the inner insert should fit closely and tightly in the fashion of a compression stocking on the leg of the user at least in the ankle region, and especially over a length of at least 3 cm, such that ticks cannot pass through in this area.

A tight, close fit of the inner insert on the foot or the leg of the user preferably occurs in that the inner insert has, at least in the lower region, and in particular in the ankle region, an elastically stretchable material. In tests which have been carried out in this context, it has been established that the material of the inner insert is preferably polyamide, polyester and/or polypropylene, in particular with an addition of elastomeric fibers.

In order to prevent the inner insert from slipping upward while a user is wearing the pants according to the invention, a loop strap for looping below the foot of the user is provided at the lower end of the inner insert. Since users to some extent have differing anatomies, the loop strap should preferably consist of an elastically stretchable material, said material having a longitudinal elongation of more than 100%, preferably of more than 120%, and in particular of more than 140%. It has been established in a particularly preferred embodiment of the invention that the longitudinal elongation should be about 150%.

In a further, particularly preferred embodiment of the invention the pant leg is openable at its lower end in the region of the inner insert. The possibility of opening the pant leg offers the advantage that a user, on the one hand, can step into a boot more easily when the pant leg is opened, and, on the other hand, that the outer region of the inner insert can be more easily cleaned or shaken out after wear by folding over or folding away the opened end of the pant leg in order to remove pests, in particular ticks, located there. In this context, a preferred embodiment of the pant leg has a longitudinal slit which reaches as far as into the calf region of the user and preferably just up to the encircling connection of the inner insert to the pant leg. Furthermore, it is advantageous in this context for the openable region of the pant leg to be quickly closable. This may be achieved for example with a zipper or a hook and loop connection.

Depending on the configuration, it is possible for the pants to be configured without an inner lining or to indeed have an inner lining. In the event that an inner lining is used, it goes without saying that the inner insert is then connected to or detachably connectable to the inner lining. In this case, the explanations made in the context of the detachable connection of the inner liner correspondingly apply.

It is favorable for the inner lining to be detachably connectable to the pants in order for the inner lining to be removed in warm weather.

In a preferred embodiment of the invention with a removable inner liner, it is provided that an encircling fastening means is located on the inner side of the pant leg so that the inner insert can also be detachably fastened on the inner side of the pant leg after removal of the inner lining. This embodiment ensures that the user can remove the inner lining but nevertheless need not dispense with the device for protection against pests, i.e. the inner insert according to the invention.

In a further, particularly preferred embodiment of the present invention, the inner insert has odor-adsorbent sorbents. This embodiment considers the fact that every human body detaches odors produced naturally in the body which are emitted into the environment. Ticks, in particular, react to these odors. The secretion of body odor can be more obviously noticed in particular in the context of physical activity, e.g. in the pursuit of leisure activities, as a result of an increase in sweating. On account of the use of odor-adsorbent sorbents in conjunction with the inner insert, the infestation by ticks is considerably diminished, since the human odor is largely reduced and ticks accordingly react less to this odor.

It is preferred in this context that the inner insert has at least one layer of activated charcoal. It is particularly preferred that the inner insert is constructed with at least three layers and has an inner carrier layer, a layer of activated charcoal, and an outer layer which faces away from the user. It goes without saying here that it is in principle also possible to manage with a greater or smaller number of layers. Accordingly, even a single-layer construction is possible in principle, if the odor-adsorbent sorbents are integrated into the carrier layer. For reasons of manufacturing, however, a construction with at least two layers having a carrier layer and a layer of activated charcoal lends itself. Apart from this, it should be ensured in this context that the material of the inner insert is configured to be gas permeable, in particular air permeable and water-vapor permeable.

Moreover, the material as such of the inner insert should be configured such that it is impenetrable for pests. The impenetrability of the material for pests, in particular ticks, is ultimately achieved by correspondingly small mesh openings. The open area of a mesh here should be smaller than 1.0 $mm^2$ and in particular smaller than 0.5 $mm^2$, with the smallest clear distance within the mesh being smaller than 0.02 mm. The weight per unit area of the material of the inner insert should be less than 100 $g/m^2$, preferably less than 80 $g/m^2$ and in particular less than 60 $g/m^2$.

The present invention furthermore relates to the use of the item of clothing according to the invention for protection against pests, in particular ticks. It is precisely the use of the pants according to the invention for the aforementioned purpose that offers significant advantages in effectively protecting the user against pests, and above all against ticks.

Further features, advantages and possibilities of application of the present invention can be gathered from the following description of exemplary embodiments with reference to the drawing and from the drawing itself. All features which are described and/or illustrated here, individually or in any combination, form the subject matter of the present invention, independently of their summary in the context of claims or their reference to other claims.

In FIG. 1, an item of clothing in the form of pants 1 is illustrated. The pants 1 are provided particularly for use in the outdoor sector and especially in the hunting sector. The pants 1 have two pant legs 2, 3.

Furthermore, the pants 1 are provided with a device for protection against pests, in particular ticks, said device being explained in more detail in the following. The upper material of the pants 1 is any desired material. It may consist here of natural and/or man-made fibers, or also of leather.

It is now essential that an inner insert 4 is provided in at least one pant leg 2, 3 as protection against pests. This inner insert 4 prevents the passage of pests, in particular ticks, through the inner insert 4 to the skin of the user. The lower end 5 of the inner insert 4 reaches here as far as the foot region 6 (FIG. 2) of the user. In the exemplary embodiment illustrated, this means that the lower end 5 of the inner insert protrudes downward beyond the lower rim 7 of the respective pant leg 2, 3. The upper end 8 of the inner insert 4 is fixedly connected (FIGS. 1 and 2) or detachably connectable (FIG. 3) to the respective pant leg 2, 3, the connection, specifically independently of whether a fixed or detachable connection is provided, being closed in an encircling manner at the upper end 8, and namely in such a manner that the pests cannot pass through the connection 9.

As can be gathered in each case from FIGS. 1 to 3, the inner insert 4 reaches inside the respective pant leg 2, 3 as far as over the calf region 10 of the user, and especially to immediately below the knee region 11. From the point of view of its length in the upward direction, the inner insert 4 ultimately corresponds to a knee-length sock.

Figure 2:
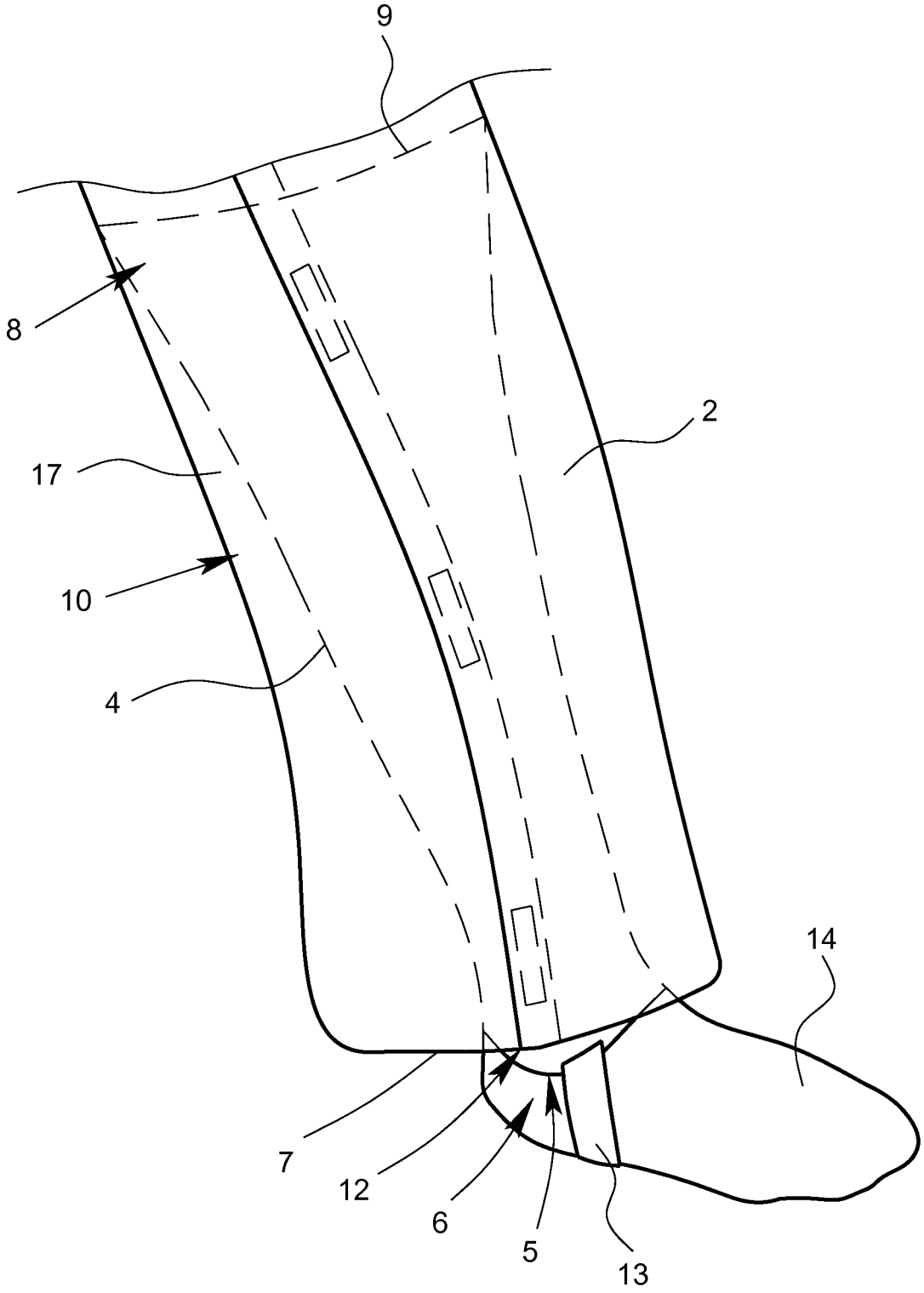
FIG. 2 shows a schematic illustration of a part of pants according to the invention in the worn state.

As is in particular evident from FIG. 2, the lower end 5 of the inner insert 4 reaches as far as into the ankle region 12 of the user. This means that the lower end 5 of the inner insert 4 reaches at least as far as the ankles of the user, preferably even completely covers the ankles. The lower end 5 of the inner insert thus extends comparatively far in the downward direction. FIG. 1 in this context elucidates that the inner insert 4 has a shape which fits tightly to the leg of the user in the ankle region 12. Here, a close and tight fit of the lower end 5 of the inner insert 4 results from bottom up over a length of at least 3 cm. It is preferable here that the lower end 5 has a tight fit at least on the entire region 12 of the ankle of the user, in the fashion of a compression stocking, but less tight. The tight fit of the inner insert 4 in the ankle region 12 is a result of the use of a correspondingly elastically stretchable material, which in the exemplary embodiment illustrated consists of a large proportion of polyamide (approx. 80%) and a lesser proportion of elastomeric fibers in the form of elastane (approx. 20%).

Moreover, two different embodiments of the inner insert 4 are illustrated in FIG. 1. The inner insert 4 in the pant leg 2 has a funnel-shaped configuration with a substantially constant taper. In contrast, the inner insert 4 in the pant leg 3 has the tightly fitting shape only at the lower end 5, but otherwise an at least substantially cylindrically shaped configuration, this having the result that the inner insert 4 fits closely only in the ankle region 12 at the lower end 5, as previously described, whilst in the worn state it is at least largely spaced at a distance from the leg of the user. It goes without saying here that this, of course, depends on the anatomy of the user. In any event, the inner insert 4 of the pant leg 3 offers more freedom of movement than the inner insert 4 of the pant leg 2. It remains to be observed that the different inserts in the embodiment according to FIG. 1 are usually not implemented in one pair of pants. As a rule, only one type of insert 4 is provided in one pair of pants 1.

Irrespective of the type of embodiment of the inner insert 4, a loop strap 13 for looping below the foot 14 of the user is provided in continuation of the lower end 5 of the inner insert 4. The actual loop strap 13 consists of an elastically stretchable material with a longitudinal elongation of about 150%.

Figure 3:
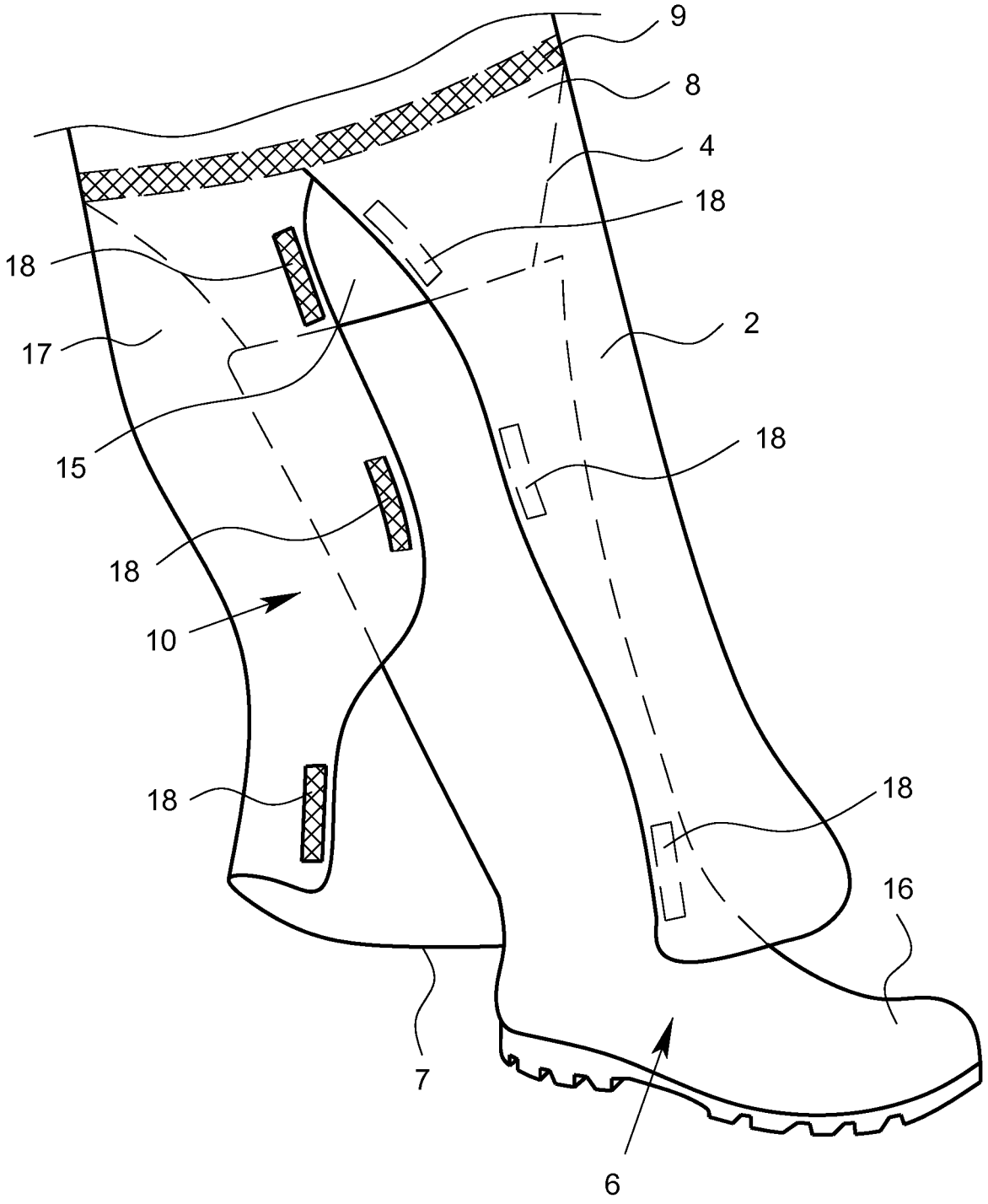
FIG. 3 shows a schematic illustration of a part of pants according to the invention with attached boot.

In FIG. 3 an embodiment is illustrated in which the connection 9 to the pant leg 2 at the upper end 8 of the inner insert 4 is detachable. A hook and loop connection serves for this purpose in the exemplary embodiment illustrated. Even if this is not illustrated in detail, the hook and loop connection on the inner side of the pant leg 2 has an encircling strip, whilst a complementary strip of the hook and loop connection is provided on the upper end 8 of the inner insert 4, such that an encircling closed connection 9 is ultimately provided. In the embodiments according to FIGS. 1 and 2, the connection 9 is implemented as an encircling seam. This is thus a fixed connection 9 of the insert 4 to the respective pant leg 2, 3.

Moreover, in the embodiment according to FIG. 3 the pant leg 2 is openable at the lower end in the region of the inner insert 4. Specifically, the pant leg 2 has a longitudinal slit 15 which reaches in the direction of the length about as far as the upper connection 9. FIG. 3 here elucidates in particular by illustrating a boot 16 that it is easy for the user to step inside the boot 16 when the longitudinal slit 15 is opened, the insert 4 then extending inside the boot 16 while the pant leg 2 extends over the leg of the boot 16. Moreover, the longitudinal slit 15 enables exposure of the inner insert 4 by pulling over the lower end 5 of the pant leg 2. In this manner, ticks or other pests trapped in the annular gap 17 between the outer side of the inner insert 4 and the inner side of the pant leg 2 may be removed. Ultimately, ticks which reach the ankle region 12 of the inner insert 4 usually crawl upward on the outer side of the inner insert 4 until the point where the inner insert 4 ends at the connection 9. A further ascent of the ticks is then no longer possible, since they are prevented by the connection 9 from crawling upward any further.

As can otherwise be gathered from FIG. 3, the longitudinal slit 15 may be closed by a hook and loop connection means 18 in order to prevent an upward swiveling of the lower end of the pant leg 2 when the user is walking.

In an embodiment which is not illustrated, the pants 1 have an inner lining. The inner lining may in this case be fixedly or detachably connected to the pants 1. When using an inner lining, the inner insert 4 may in turn be fixedly or detachably connected to the inner lining. If the inner lining is removed, it is in principle possible to achieve a state as illustrated in FIG. 3, the detachably connectable inner insert 4 in turn then being connected to the pant leg 2.

Figure 4:
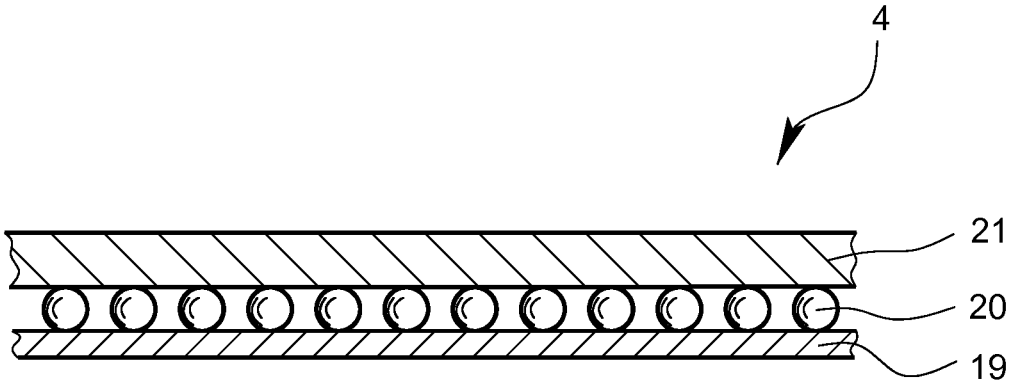
FIG. 4 shows a schematic illustration of a layered configuration of the material of the inner insert according to the invention.

In FIG. 4 a part of the material of the inner insert is illustrated. In the exemplary embodiment illustrated, the inner insert 4 has an odor-adsorbent material which has an inner carrier layer 19 as textile sheet-like material, activated charcoal in the form of activated charcoal granules 20 being affixed on the carrier layer 19. Affixing may occur by means of an adhesive (not illustrated). The material of the inner insert 4 furthermore has an outer layer 21 on the side of the activated charcoal granules 20 which faces away from the carrier layer 19.

In the exemplary embodiment illustrated, the material of the inner insert 4 has activated charcoal granules 20 with a weight per unit area of approx. 35 g/m$^2$ and a mean diameter of approx. 0.4 to 0.6 mm, said activated charcoal granules being affixed to the inner carrier layer 19 with an adhesive applied in a punctiform manner. A polyester and/or polyamide material as sheet-like structure is likewise provided as inner carrier layer 19 and outer layer 21.

LIST OF REFERENCE SIGNS

1 Pants
2 Pant leg
3 Pant leg
4 Inner insert
5 Lower end
6 Foot region
7 Rim
8 Upper end
9 Connection
10 Calf region
11 Knee region
12 Ankle region
13 Loop strap
14 Foot
15 Longitudinal slit
16 Boot
17 Annular gap
18 Hook and loop connection means
19 Carrier layer
20 Activated charcoal granules
21 Outer layer

The invention claimed is:

1. An item of clothing in the form of pants for use outdoors and in hunting, having two pant legs and a device for protection against pests in the form of an inner insert configured to prevent the passage of pests, being provided in at least one of the pant legs as the device for protection against pests, a lower end of said insert configured to reach as far as into a foot region of a user, and an upper end of said insert being fixedly connected or detachably connectable to the at least one of the pant legs on an inside of said at least one of the pant legs, the connection at the upper end of said insert being closed in an encircling manner such that a passage of the pests is not possible through the connection;

wherein said lower end of the inner insert protrudes downward beyond a lower rim of the at least one of the pant legs;

wherein the inner insert has a shape which is configured to fit tightly to a leg of the user at least in an ankle region of the user;

wherein the inner insert is configured to be worn in the ankle region, such that a close fit is adapted to result on an ankle surface of the user;

wherein the material of the inner insert is configured such that the material is impenetrable for pests due to correspondingly small mesh openings in the material;

wherein the inner insert is constructed with at least three layers including an inner carrier layer, an intermediate odor-adsorbent layer of activated charcoal, and an outer layer which is configured to face away from the user; and wherein said layer of activated charcoal includes activated charcoal granules affixed to the inner carrier layer with an adhesive applied in a punctiform manner.

2. The item of clothing as claimed in claim 1, wherein the upper end of the insert in the at least one of the pant legs with the insert is configured to be fastened in a calf area of the user.

3. The item of clothing as claimed in claim 1, wherein the upper end of the insert in the at least one of the pant legs with the insert is configured to be fastened in an upper calf area of the user.

4. The item of clothing as claimed in claim 1, wherein the upper end of the insert in the at least one of the pant legs with the insert is configured to be fastened below a knee region of the user.

5. The item of clothing as claimed in claim 1, wherein the inner insert has, at least in an area configured to correspond to the ankle region of the user, an elastically stretchable material and wherein an addition of elastomeric fibers is provided.

6. The item of clothing as claimed in claim 5, wherein the elastomeric fibers comprise elastane.

7. The item of clothing as claimed in claim 1, wherein the inner insert has, as main components, at least one of polyamide, polyester and polypropylene, and wherein an addition of elastomeric fibers is provided.

8. The item of clothing as claimed in claim 7, wherein the elastomeric fibers comprise elastane.

9. The item of clothing as claimed in claim 1, wherein a loop strap for looping below the foot of the user is provided at the lower end of the inner insert.

10. The item of clothing as claimed in claim 9, wherein the loop strap consists of an elastically stretchable material.

11. The item of clothing as claimed in claim 9, wherein the loop strap has a longitudinal elongation at break of more than 100%.

12. The item of clothing as claimed in claim 9, wherein the loop strap has a longitudinal elongation at break of more than 120%.

13. The item of clothing as claimed in claim 9, wherein the loop strap has a longitudinal elongation at break of more than 140%.

14. The item of clothing as claimed in claim 1, wherein the at least one of the pant legs with the insert is openable at the lower rim in a region of the inner insert, wherein the at least one of the pant legs with the insert has a longitudinal slit which is configured to reach as far as into or above a calf region of the user and below said upper end of said insert.

15. An item of clothing in the form of pants for use outdoors and in hunting, having two pant legs and a device for protection against pests in the form of an inner insert configured to prevent the passage of pests, being provided in at least one of the pant legs as the device for protection against pests, a lower end of said insert configured to reach as far as into a foot region of a user, and an upper end of said insert being fixedly connected or detachably connectable to the at least one of the pant legs on an inside of said at least one of the pant legs, the connection at the upper end of said insert being closed in an encircling manner such that a passage of the pests is not possible through the connection;

wherein said lower end of the inner insert protrudes downward beyond a lower rim of the at least one of the pant leas;

wherein the inner insert has a shape which is configured to fit tightly to a leg of the user at least in an ankle region of the user;

wherein the inner insert is configured to be worn in the ankle region, such that a close fit is adapted to result on an ankle surface of the user;

wherein the material of the inner insert is configured such that the material is impenetrable for pests due to correspondingly small mesh openings in the material;

wherein the inner insert has odor-adsorbent sorbents;

wherein a loop strap for looping below the foot of the user is provided at the lower end of the inner insert, and wherein the loop strap consists of an elastically stretchable material attached to the insert below the lower rim of at least one of the pant legs.

16. An item of clothing in the form of pants for use outdoors and in hunting, having two pant legs and a device for protection against pests in the form of an inner insert configured to prevent the passage of pests being provided in at least one of the pant legs as the device for protection against pests, a lower end of said insert configured to reach as far as into a foot region of a user, and an upper end of said insert being fixedly connected or detachably connectable to the at least one of the pant legs on an inside of said at least one of the pant legs, the connection at the upper end of said insert being closed in an encircling manner such that a passage of the pests is not possible through the connection;

wherein said lower end of the inner insert protrudes downward beyond a lower rim of the at least one of the pant legs;

wherein the inner insert has a shape which is configured to fit tightly to a leg of the user at least in an ankle region of the user;

wherein the inner insert is configured to be worn in the ankle region, such that a close fit is adapted to result on an ankle surface of the user;

wherein the inner insert has odor-adsorbent sorbents;

wherein the at least one of the pant leas with the insert is openable at a lower end in a region of the inner insert, and wherein the at least one of the pant legs with the insert has a longitudinal slit which is configured to reach as far as into or above a calf region of the user and below said upper end of said insert.

17. An item of clothing in the form of pants for use outdoors and in hunting, having two pant legs and a device for protection against pests in the form of an inner insert configured to prevent the passage of pests, being provided in at least one of the pant legs as the device for protection against pests, a lower end of said insert configured to reach as far as into a foot region of a user, and an upper end of said insert being fixedly connected or detachably connectable to the at least one of the pant leas on an inside of said at least one of the pant legs, the connection at the upper end of said insert being closed in an encircling manner such that a passage of the pests is not possible through the connection;

wherein said lower end of the inner insert protrudes downward beyond a lower rim of the at least one of the pant legs;

wherein the inner insert has a shape which is configured to fit tightly to a leg of the user at least in an ankle region of the user in the ankle region, such that a close fit is adapted to result on an ankle surface of the user;

wherein the inner insert is configured to be worn in the ankle region, such that a close fit is adapted to result on an ankle surface of the user;

wherein the inner insert has odor-adsorbent sorbents;

wherein a loop strap for looping below the foot of the user is provided at the lower end of the inner insert;

wherein the loop strap consists of an elastically stretchable material;

wherein the at least one of the pant legs with the insert is openable at a lower end in a region of the inner insert, and wherein the at least one of the pant legs with the insert has a longitudinal slit which is configured to reach as far as into or above a calf region of the user and below said upper end of said insert.

18. An item of clothing in the form of pants for use outdoors and in hunting, having two pant legs and a device for protection against pests in the form of an inner insert configured to prevent the passage of pests, being provided in at least one of the pant legs as the device for protection against pests, a lower end of said insert configured to reach as far as into a foot region of a user, and an upper end of said insert being fixedly connected or detachably connectable to the at least one of the pant legs on an inside of said at least one of the pant legs, the connection at the upper end of said insert being closed in an encircling manner such that a passage of the pests is not possible through the connection;

wherein in a relaxed configuration of the inner insert, said lower end of the inner insert protrudes downward beyond a lower rim of the at least one of the pant legs when said at least one of the pant legs is completely extended taut;

wherein the inner insert has a shape which is to fit tightly to a leg of the user at least in an ankle region of the user;

wherein the inner insert is configured to be worn in the ankle region, such that a close fit is adapted to result on an ankle surface of the user;

wherein the material of the inner insert is configured such that the material is impenetrable for pests due to correspondingly small mesh openings in the material; and wherein the inner insert has odor-adsorbent sorbents.

19. An item of clothing in the form of pants for use outdoors and in hunting, having two pant legs and a device for protection against pests in the form of an inner insert configured to prevent the passage of pests, being provided in at least one of the pant legs as the device for protection against pests, a lower end of said insert configured to reach as far as into a foot region of a user, and an upper end of said insert being fixedly connected or detachably connectable to the at least one of the pant legs on an inside of said at least one of the pant legs, the connection at the upper end of said insert being closed in an encircling manner such that a passage of the pests is not possible through the connection;

wherein in a relaxed configuration of the inner insert, said lower end of the inner insert protrudes downward beyond a lower rim of the at least one of the pant legs when said at least one of the pant legs is completely extended taut;

wherein the inner insert has a shape which is configured to fit tightly to a leg of the user at least in an ankle region of the user;

wherein the inner insert is configured to be worn in the ankle region, such that a close fit is adapted to result on an ankle surface of the user;

wherein the inner insert has odor-adsorbent sorbents;

wherein a loop strap for looping below the foot of the user is provided at the lower end of the inner insert, and wherein the loop strap consists of an elastically stretchable material.

20. An item of clothing in the form of pants for use outdoors and in hunting, having two pant legs and a device for protection against pests in the form of an inner insert configured to prevent the passage of pests being provided in at least one of the pant legs as the device for protection against pests, a lower end of said insert configured to reach as far as into a foot region of a user, and an upper end of said insert being fixedly connected or detachably connectable to the at least one of the pant legs on an inside of said at least one of the pant legs, the connection at the upper end of said insert being closed in an encircling manner such that a passage of the pests is not possible through the connection;

wherein in a relaxed configuration of the inner insert, said lower end of the inner insert protrudes downward beyond a lower rim of the at least one of the pant legs when said at least one of the pant legs is completely extended taut;

wherein the inner insert has a shape which is configured to fit tightly to a leg of the user at least in an ankle region of the user;

wherein the inner insert is configured to be worn in the ankle region, such that a close fit is adapted to result on an ankle surface of the user;

wherein the inner insert has odor-adsorbent sorbents;

wherein the at least one of the pant legs with the insert is openable at a lower end in a region of the inner insert, and wherein the at least one of the pant leas with the insert has a longitudinal slit which is configured to reach as far as into or above a calf region of the user and below said upper end of said insert.

21. An item of clothing in the form of pants for use outdoors and in hunting, having two pant legs and a device for protection against pests in the form of an inner insert configured to prevent the passage of pests, being provided in at least one of the pant legs as the device for protection against pests, a lower end of said insert configured to reach as far as into a foot region of a user, and an upper end of said insert being fixedly connected or detachably connectable to the at least one of the pant legs on an inside of said at least one of the pant legs, the connection at the upper end of said insert being closed in an encircling manner such that a passage of the pests is not possible through the connection;

wherein said lower end of the inner insert protrudes downward beyond a lower rim of the at least one of the pant legs in a relaxed configuration of the inner insert, when said at least one of the pant legs is completely extended taut;

wherein the inner insert has a shape which is configured to fit tightly to a leg of the user at least in an ankle region of the user;

wherein the inner insert is configured to be worn in the ankle region, such that a close fit is adapted to result on an ankle surface of the user;

wherein the inner insert has odor-adsorbent sorbents;

wherein a loop strap for looping below the foot of the user is provided at the lower end of the inner insert;

wherein the loop strap consists of an elastically stretchable material;

wherein the at least one of the pant legs with the insert is openable at a lower end in a region of the inner insert, and wherein the at least one of the pant legs with the insert has a longitudinal slit which is configured to reach as far as into or above a calf region of the user and below said upper end of said insert.

22. An item of clothing in the form of pants for use outdoors and in hunting, having two pant legs and a device for protection against pests in the form of an inner insert configured to prevent the passage of pests, being provided in at least one of the pant legs as the device for protection against pests, a lower end of said insert configured to reach as far as into a foot region of a user, and an upper end of said insert being fixedly connected or detachably connectable to the at least one of the pant legs on an inside of said at least one of the pant legs, the connection at the upper end of said insert being closed in an encircling manner such that a passage of the pests is not possible through the connection;

wherein said lower end of the inner insert protrudes downward beyond a lower rim of the at least one of the pant legs;

wherein the inner insert has a shape which is configured to fit tightly to a leg of the user at least in an ankle region of the user;

wherein the inner insert is made of a mesh material and is configured to be worn in the ankle region, such that a close fit is adapted to result on an ankle surface of the user;

wherein the mesh material of the inner insert is configured such that the mesh material is impenetrable for pests due to correspondingly small openings in the mesh material;

wherein the impenetrability of the material for pests is ultimately achieved by correspondingly small openings, wherein an open area of a pore of the mesh is smaller than 1.0 $mm^2$, with the smallest clear distance within the mesh being smaller than 0.02 mm; and wherein the inner insert has odor-adsorbent sorbents.

* * * * *